United States Patent [19]

Eickmann

[11] Patent Number: 4,471,729

[45] Date of Patent: Sep. 18, 1984

[54] VALVE ARRANGEMENT PREFERRED FOR ENGINES

[76] Inventor: Karl Eickmann, 2420 Isshiki, Hayama-machi, Kanagawa-ken, Japan

[21] Appl. No.: 356,663

[22] Filed: Mar. 10, 1982

Related U.S. Application Data

[62] Division of Ser. No. 807,975, Jun. 20, 1977.

[51] Int. Cl.[3] ..... F01L 1/30

[52] U.S. Cl. ..... 123/90.26; 251/215; 251/229

[58] Field of Search ..... 123/90.29, 90.25, 90.26; 251/215, 229

[56] References Cited

U.S. PATENT DOCUMENTS 1,289,606 12/1918 Barthel ..... 123/90.26

*Primary Examiner*—Wendell E. Burns

[57] ABSTRACT

In typical combustion engines the inlet valves and outlet valves are subjected to lifting mechanism and to long stroke springs for closing the valves in periodic cycles. Strong and long springs are required and their life time is limited. The invention therefore provides a valve arrangement, wherein the springs are not providing strokes, but act merely only to adjust mechanical clearances. The springs are becoming short thereby and the life time increases. The strokes of the valves are actuated by a novel cam shaft which extends through a window in the shaft of the respective valve. Further details are provided to secure a smooth operation of the valve arrangement, to reduce the weight thereof and to provide proper lubrication of the rotary cam shaft. The number of reciprocating elements is reduced.

4 Claims, 12 Drawing Figures

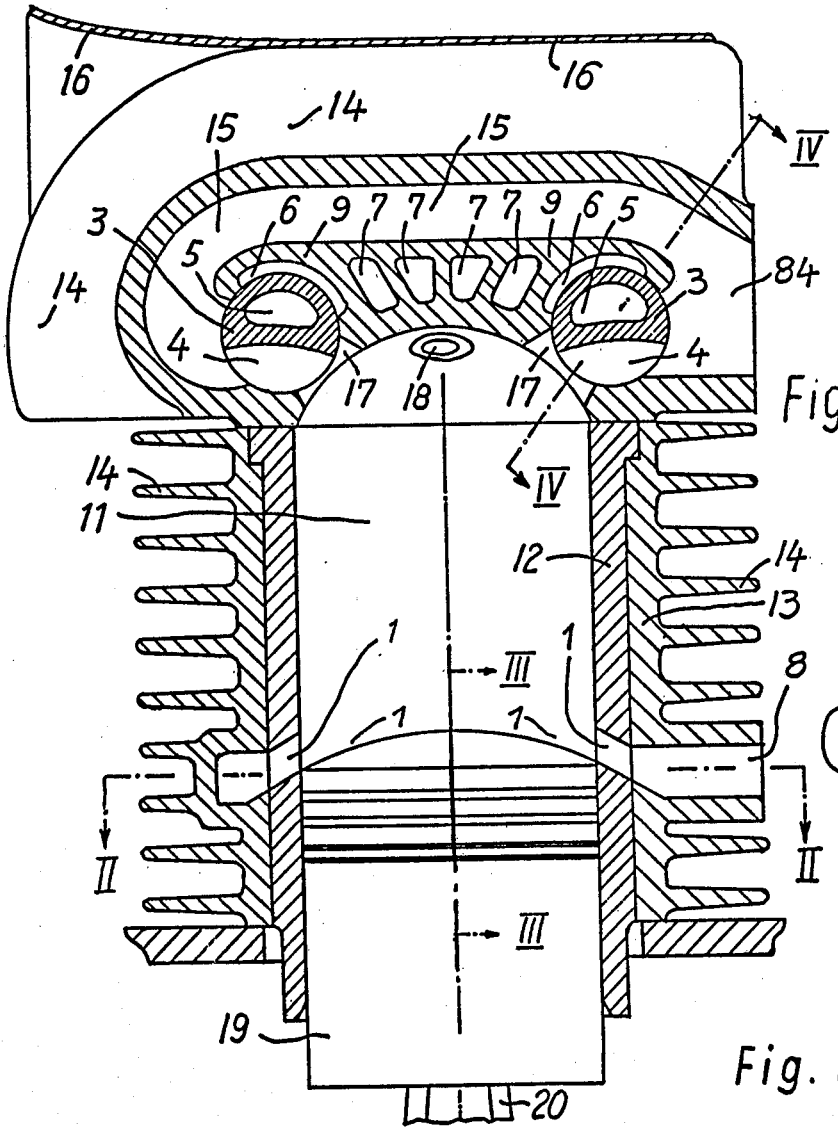
Fig. 1
Fig. 3
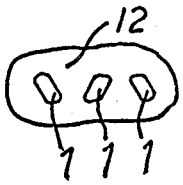
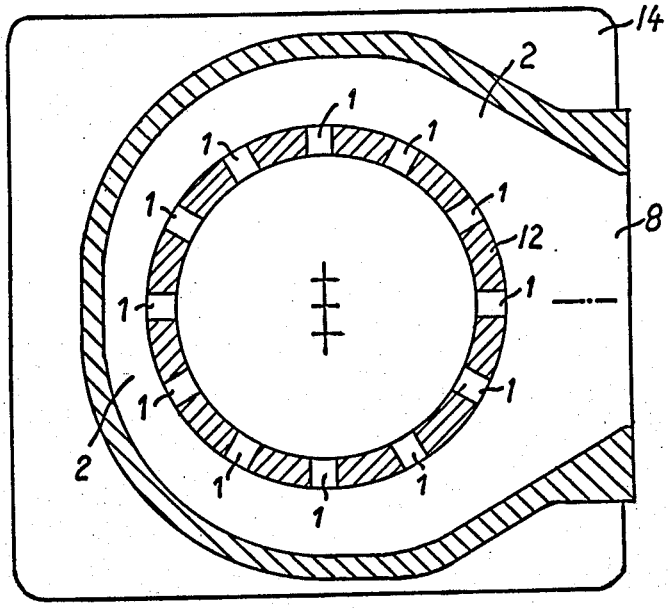
Fig. 2

VALVE ARRANGEMENT PREFERRED FOR ENGINES

REFERENCE TO A RELATED APPLICATION

This is a divisional application of my copending application, Ser. No. 807,975, which was filed on June 20th, 1977.

BACKGROUND OF THE INVENTION

Four-stroke and two-stroke combustion engines are widely used and each of them has features and also difficulties. The features of the four-stroke engines is the good efficiency because the cylinder is cleaned out by force after each working stroke. Since at four strokes only one working stroke appears, the engines are of less power per unit of weight.

The two-stroke engines have big power per unit of weight, because they have a working stroke at every two strokes. However their efficiencies are bad, because the cylinders are not cleaned by force. Therefore full filling with clean gas-air mixture is not assured.

A difficulty of both types of common engines is, that the cross-sectional areas for intake and exhaust are limited because there is not enough space for a maximum of inlet and exhaust area.

SUMMARY OF THE INVENTION OF THE PARENTAL APPLICATION

The purpose of this invention is, to at least partially overcome the mentioned difficulties of the known common combustion engines and at the same time to increase the reliability, the power per unit of weight and under certain conditions also to increase the efficiency of the engines.

One object of the invention is to do away with the outlet valves and the exhaust pipes of the four stroke engines. Because the outlet valves are subjected to high heat, which reduces their life time and reliability.

A means of said object of the invention is, to provide outlet slots above the bottom position of the piston through the cylinder walls.

Another object of the invention is, to provide an exhaust collection chamber around the said slots in the cylinder walls.

A further object of the invention is, to provide said slots angularily spaced around the whole cylinder wall portion, whereby a maximum of outlet cross-sectional area is obtained, while at same design the slots can be short in the direction of the piston stroke.

It is therefore another object of the invention, to increase the cross-sectional area of outlet slots in combination with shortening of their height in order to obtain a maximum of closed working space in the cylinder.

Another object of the invention is, to set a drive unit for driving a loader, for example a common super charger unit directly onto the exhaust outlet without the need of piping around a half of the engine.

A related object of the invention is, to use said loader or turbocharger directly before the inlet valve without need of piping around a half of the engine.

A further object of the invention is, to utilize an inlet valve of higher speed, more reliability and of bigger inlet area.

Another object of the invention is, to set a plurality of inlet valves in order to increase the inlet area and/or in order to allow higher rpm of the engine.

Another object of the invention is, to provide a high speed rotary inlet valve.

A further object of the invention is, to provide balancing means and cooling means to a rotary inlet valve in order to improve the tightness and life time as well as reliability of the inlet valve.

A still further object of the invention is, to provide space for double ignition plugs.

Another object of the invention is, to provide an improved cylinder head of easy configuration for easy machining, better cooling and prevention of the heated complicatioded portions of the cylinder head of former four stroke engines in the surrounding of the former outlet valves of the former engines.

Still a further object of the invention is to provide at least two inlet streams whereof one is a pure air stream for cleaning of the cylinder from exhaust gases and the other is an air-mixture stream for filling of the cylinder with cumbustible mixture.

And a final object of the invention is, to provide a turbo- or other charger with two supply chambers for compressed gas. One thereof for clean pure air, while the other may be for air-fuel mixture.

With said objects of the invention materialized by this present invention, the common four stroke engine can keep its parts, but has to replace only the cylinder block and the valve head or inlet head. By setting the cylinder block and the inlet head together with the loading unit to the engine, the power of the common heretofore four-stroke engine becomes 3,5 fold by this invention. Because the turbocharger doubles the power generally, while the transformation by this invention changes the engine from four-stroke to two-stroke whereby the number of working strkes is doubled and consequentely the power respectively increased. The efficiency of the four stroke system is fully maintained by the invention, because the cylinder is cleaned by force. This was not possible by common two stroke engines. A little bit working volume of about 10 percent is lost by the provision of the outlet slots of the invention, but the increase in power is so extensive, that this little loss can be accepted.

For higher efficiency the engine can run with a high air-ratio "lambda", whereby the thermal and overall efficiency increases.

SUMMARY OF THE INVENTION OF THIS PRESENT APPLICATION

The object of the present application is, to provide an inlet valve or outlet valve arrangement which is operated by a rotary shaft with eccentric guide faces of a cam which is located on the rotary shaft. The shaft extends through a window in the shaft of the respective valve. The cam revolves in the window of the shaft of the valve and thereby provides the strokes of the respective valve.

The object of the present divisonal application is thereby also to provide a rotary drive arrangement to inlet valves and outlet valves to prevent long and heavy strong springs.

An other object of the invention is thereby also, to eliminate rockers and other reciprocating driving mechanism.

And, the final object of the invention is, to provide a reliable valve arrangement for engines, compressors, pumps and other devices.

BRIEF DESCRIPTION OF THE DRAWING

FIG. 1 is a longitudinal sectional view through an engine portion of the invention.

FIG. 2 is a cross-sectional view through FIG. 1 along II—II.

FIG. 3 is a view from inside the cylinder along III—III.

DESCRIPTION OF THE PREFERRED EMBODIMENTS

Figure 4:
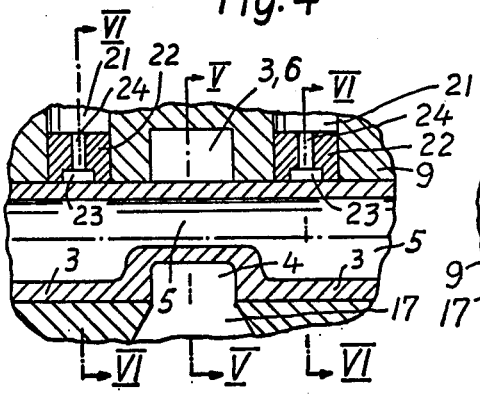
FIG. 4 is a partial sectional view through FIG. 1 along IV—IV.

Cylinderliners 12 which are also called the cylinder bushes form the cylinder 11 which is closed on top by the cylinder head 9. From bottom of the there open cylinder 11 the piston 19 moves upward and downward within cylinder 11. The piston 19 is driven by and drives the commonly used crankshaft over the conrod 20, which is the connecting rod between the cranksaft and the piston. Thus, the piston moves up and down in the cylinder and thereby compresses and expands the cylinder space. This known cycle is used to compress air or air-fuel mixture, to ignite it, combust it and utilize the burning or burned gases to drive the piston in the expansion stroke, which gives the power to the engine. Thereafter the expanded gases are exiting out from the cylinder. The words "up" and "down" are used in relation to FIG. 1, and so are the referentials mentioned in the above description of the common engine of the former art.

There were and are two major difficulties in those engines of the former art. In two-stroke engines the cylinder could not be cleaned by force. Therefore, old burned gases remained remained partially in the cylinder. That prevented clean burning of the new charge with best efficiency. The application of entrance of mixture under pre-compression in the crankcase of two-stroke engines made double sets of ports necessary in the cylinder walls. Since there is only limited space in a cylinder wall, the cross-sectional areas of the entrance and exit slots in two stroke engines could not become widely enlarged, as the enlargement of said cross-sectional areas is limited. Thus, the power and efficiency of the common two-stroke engines could not be increased without limit. The common four-stroke engine does not have the difficulties of cleaning of the cylinder from residue of burned gases. Because it has a specific exhoust stroke, which sends the rest of burned gases of the prior working stroke by use of force of the moving piston. However, in order to achieve this feature of good cleaning and loading of the cylinder the four stroke engine has to use inlet valves and outlet valves, which must be timely opened and closed by mechanical drive means. The exhaust or outlet valve is subjected to the heat of the hot outgoing gases. It operates in this heat.

The heat on the outlet valve and its surrounding parts and portions is therefore a main limitation to the existing four stroke engines. The requirements of four piston strokes or two revolutions in order to achieve a single working or power stroke limits the power of four stroke engines per unit of weight.

By this present invention these mentioned difficulties of four stroke - and of two stroke engines of today's common use will at least partially or almost completely be overcome.

For this purpose, the invention prevents the application of exhaust valves. Instead it provides the slots 1 of the invention through the cylinder wall 12. Said slots 1 are set so, that they are slightly above the most downward position of the piston 19. It is preferred to provide an annullar exhaust collection space 2 around the cylinder bush 12. The parts or slots 1 of the invention open and communicate to said exhaust collection space or exhaust collection chamber 2.

Collection chamber 2 may be made of increased cross-sectional area towards the exhaust port 8 in order to obtain equal velocities over the entire exhaust collection chamber 2. In accordance with the invention it is possible to space the slots 1 of the invention regularily at angular intervalls over the whole 360 degrees of the cylinder wall. This is demonstrated in cross-sectional FIG. 2. Said FIG. 2 also demonstrates the preferred enlargement of cross-sectional area of collection chamber 2 towards the exhoust port 8.

Since the common two-stroke engine requires inlet slots and outlet slots, but the engine of this invention requires only outlet slots 1 in the bottom portion of the cylinder wall, it is clearly evident, that the exhaust slots 1 of the invention can be made substantially of twice the cross-sectional area of that of common two-stroke engines. Consequently in the engine of the invention it is substantially possible to exit twice as much burned gases, as in the common two-stroke engine.

The outlet slots 1 may be set in inclined angles as shown in FIGS. 3 in order to have a good guide for the piston rings, so, that the piston rings will not break, when they move during piston stroke over the outlet slots 1 of the invention.

According to the here described perferred embodiment of the figures of the invention, the exhaust port 8 is connected to a gas motor or to a turbocharger turbine unit. For example to entrance port 70 of FIG. 12. The gas-motor or turbine 71 drives a loader 69 which sucks in air or air-fuel mixture through entrance port 66 and supplies it as a compressed air or compressed mixture out of exit port 69 into entrance port 84 of the engine.

Instead of sending the exhoust gases through the gas motor or turbine 71, the exhaust gases can also be send through a muffler out into the atmosphere. In such case however a compressing unit or loader must be driven by other means. For example by the crankshaft or another rotary member of the engine or by an external power source.

Figure 12:
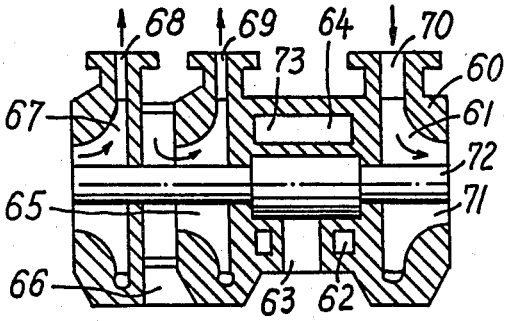
FIG. 12 is a longitudinal sectional view through a turbocharger of the invention to be applied to the engine of the invention.

The most economic and the most convenient one, also not at all cases the most inexpensive one is a turbocharger of FIG. 12 or a turbocharger with only one compressor. It will be noted, that, as commonly known, the shaft 72 is borne in bearing 73 and connects the expansion rotor 71 with compression rotor 65 for revolving both in unison. Lubricating chamber 64 lubricates shaft 72 in bearing 73 and exit port 63 is provided for the leaking lubrication fluid.

According to the preferred embodiment and also in accordance with the invention at least one inlet valve means 3 is provided in the cylinder head 9 of the engine of the invention. This valve means 3 is operated in cycle with the moving piston 19 and synchronized to piston 19 timely. That may be done by mechanical means, for example by common drive means, like, gear, chain, belt and like. Inlet valve means 3 provides the opening and closing of inlet passage 4. Commonly there is also an inlet fluid collection or supply chamber before the inlet passage 4. That is however not shown in the drawing because it is commonly incorporated into the inlet passage from the loader to the inlet passage.

When the piston 19 moves downward and thereby opens the outlet slots 1 of the invention, the compressed air or air-fuel mixture enters through the then open entrance passage 4 into the cylinder 11 and thereby presses the rest of the old burned gases of former working stroke out of the cylinder 11 through the exit slots 1 of the invention. This continues until the later upwards moving piston 19 closes the slots 1 of the invention. After enough new air or air-fuel mixture will have filled the cylinder 11, the entrance passage 4 closes and the gas in the cylinder becomes compressed during the further compression stroke or upward move of piston 19. When the piston is near to its uppermost position either the air-fuel mixture becomes ignited by spark plugs 18 or fuel becomes injected into the hot air in the cylinder 11 by a fuel injection nozzle 18. Spark plug and fuel injection nozzle have equal referentials 18, because in accordance with the invention both are applicable alternatives. The engine can run in Otto-type ignition of air-fuel mixture or in Diesel type fuel injection into compressed hot air in the cylinder. Depending on compression ratio and other design consideration, the user of the engine of the invention selects either an ignition means 18 in the cylinder head or a fuel injection means 18 in the cylinder head 9.

The elimination of the exhaust valve in the cylinder head provides in accordance with this invention, much space in the cylinder head to set double ignition plugs 18 or to set double injection nozzles 18 into the cylinder head.

It also provides much space for cooling ribs or other cooling means. These provisions of the invention provide a higher reliability and a longer life to the engine.

The embodiment of the inlet valve shown in FIG. 1 is in detail demonstrated in FIGS. 1 and 4 to 6. It is rotatably borne in the cylinder head 9 or thereon. The rotation is provided by commonly known mechanical means, as chain, gear, belt and coupled into unison with the crankshaft or another moving member of the engine.

At right time, when the piston is near its bottom-most position and the slots 1 are opening, the inlet passage 4 opens the entrance from entrance port 84 into cylinder 11. The air or air fuel mixture is then forced by the loader, compressor or turbocompressor 69 into cylinder 11, until the said cylinder is free of exhaust gases and completely filled with new air or mixture. Thereafter by revolving further, the closing portion of the valve 3 closes the cylinder 11. Said closing portion of valve 3 is demonstrated in FIG. 5. The open position is demonstrated in FIGS. 1 and 4. Thus, FIG. 5 shows the valve 3 in a turned position.

Valve 3 may be a rotating shaft. It may be hollow and be provided with cooling passage 5 for cooling of the valve 3.

Figure 5:
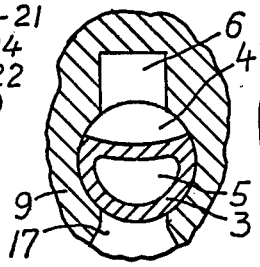
FIG. 5 is a cross-sectional view through FIG. 4 along V—V.
Figure 6:
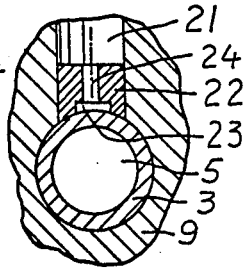
FIG. 6 is a cross-sectional view through FIG. 4 along VI—VI.

FIGS. 4 and 6 demonstrate, how it can be assured, that at closing position the valve 3 is alltimes closely sealingly pressed against the respective portion of the cylinder head 9. For that purpose the pressure chambers 21 may be provided in the cylinder head 9 or a respective bearing member. Thrust bodies 24 are axially moveable in said pressure chambers 21. Passage means 24 may extend through thrust body 22 into a fluid pocket or pockets 23. During operation fluid is let into thrust chambers 21. Thrust chambers 21 may be located opposite diametrically to the entrance flow passage 17 or laterally distanced therefrom. For example, as shown in FIG. 4. The fluid, led into the thrust chambers 21 may be lubrication oil or gas. The pressure may be supplied by an external pumping source or pressure source or by communication with the fluid pressure in the cylinder 11. The cross-sectional area of thrust body 22 or of all of them in the sum, is so calculated, that the force excerted by it against the valve 3 is alltimes oppositionally directed against the pressure in cylinder 11 and in flow passage 17 but alltimes a little bit higher than the force out of passage 17 against the valve 3. Thus, under all conditions the valve body 3 remains pressed against the sealing surface portion of the valve head 9 and thereby the valve 3 closes the cylinder perfectly, when revolved into into its closing position as shown in FIG. 5.

Figure 7:
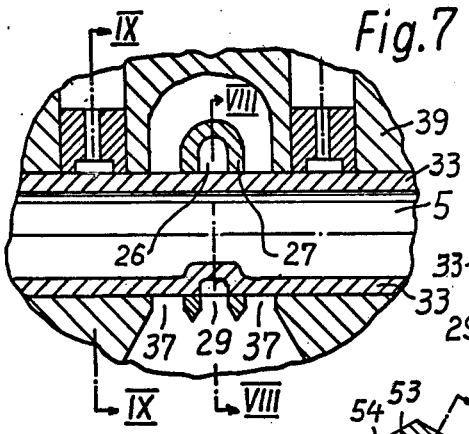
FIG. 7 is an alternative to FIG. 4 in equal view.
Figure 8:
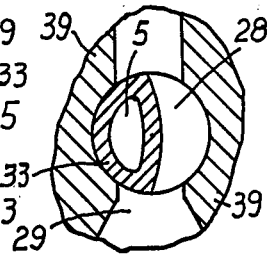
FIG. 8 is a cross-sectional view through FIG. 7 along VIII.
Figure 9:
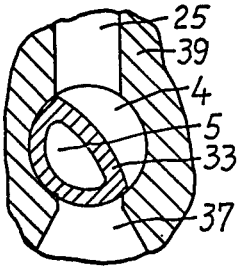
FIG. 9 is a cross-sectional view through FIG. 7 along IX—IX.

In FIGS. 7 to 9 an alternative to valve 3 of FIGS. 1, 4, 5, 6 is demonstrated. In FIGS. 7 to 9 the cylinder head has two or three, in short a plurality of inlet und flow ports or passages. Namely inlet ports 25 and 26 and passages 29 and 37. One port and one of the passages is for inlet of pure compressed air. The other may be for inlet of fuel-air mixture. Respectively the valve 33 has two different inlet openings, namely 28 and 4.

FIG. 8 shows the inlet opening 28 in the opened position. Fresh compressed air flows for example from a loader air compressor 67 of FIG. 12 through exit port 68 of FIG. 12 into inlet port 26 of FIG. 8, therefrom through valve inlet opening 28 into flow passage 29 and therefrom into the cylinder 11. It presses all residue of old burned gases from the earlier working stroke out of cylinder 11. When this procedure is completed, the valve 33 has in the meanwhile continued its revolving. Port 28 now closes and inlet opening 4 of FIG. 9 begins to open. The fluid-fuel mixture now flows for example from the respective loader or from fuel-mixture compressor 65 of FIG. 12 through exit port 69 into the entrance port 25 of FIG. 9. Therefrom the air fuel mixture flows through the valve opening 4 into the flow passage 37 and therefrom into the cylinder 11. As soon as the cylinder is filled with the fuel-air mixture, the outlets slots 1 are closed by the piston 19. The piston then compresses the mixture in the cylinder, because at about the same time, when the slots 1 are closing, the inlet opening 4 closes also, because the valve 33 continues the rotation. Thus, when the outlet slots 1 are closed, the inlet valve openings 28 and 4 are also closed. The piston now continues to do its compression stroke, until about an uppermost position the ignition plug or plugs are firing, the mixture burns and thereafter the expansion or working stroke occures, when the piston 19 moves downwrad again, until the outlet slots 1 open and the expanded gases exhoust outwards through the slots 1 adn the collection chamber 2. The cycle is completed.

The engine, thus has given one complete working cycle at a single revolution of the crankshaft. The power is thereby substantially doubled compared to the four stroke engine. It is not exactly doubled, because the slots 1 of the invention take a portion of the compression and expansion stroke away compared to four stroke engines. The slots 1 of the invention extend however only over a small portion of the piston stroke, for example 10 to 20 percent. Thus, the power of the engine increases to about 1,6 to 1,9 over the power of the common four stroke engine.

Since it is one object of the invention, to eliminate the hot exhaust valve of the common four stroke engine, the invention obtained free space in the cylinder head, which can, in accordance with the invention be utilized to set a second inlet valve into the cylinder head. Such possibility is demonstrated in FIG. 1. On the left side of cylinder head 9 we see the second inlet valve 3 with second inlet opening 4 in valve 3. Overflow passage 15 communicates inlet port 84 not only to inlet opening 4 of the right inlet valve 3, but also to the second, the left inlet valve 3 and thereby to both openings 4 of both valves 3.

By this provision of the invention the inlet flow through cross-sectional area is doubled compared to common four stroke engines, whereby the engines can run at higher rpm, because almost double the amount of air or fuel-air mixture can now be led into the cylinder 11 in accordance with the invention. Namely 1,6 to 1,9 times more than in the common four stroke engine.

Thus, the power is not only almost doubled compared to four stroke engines by providing double working strokes per equal crankshaft revolution, but the power is again almost doubled by provision of double inlet area by the invention. Thus, the engine can revolve with higher rpm than the common four stroke engine. In short, the power of the engine of the invention can become increased almost 3,5 times over the power of a common four stroke engine of equal size. At same time the weight is reduced, because the rotary valves 3 need less weight, than the common cam-shaft assembly with axially moving valves of common four stroke engines.

Cover 16 provides a good guide for ram air through the spaces between ribs 15 of the valve head for cooling the valve head effectively when the engine moves foreward in a car, motorbike or in an aircraft or like. Cylinder ribs 14 are common cooling ribs. Instead of air-cooling as shown in the figures, the engine can also use water cooling.

Instead of providing rotary valve 3 in the cylinder head it is also possible to leave the common inlet valve in the cylinder head. In such case only the cam shaft has to be modified, in order to provide one opening of the inlet valve at one rotation of the crankshaft. This can also be achieved by providing the common camshaft with equal revolution as the crankshaft. The camshaft in an engine of common type revolves only with half of the rpm of the crankshaft. Thus, just by changing the drive gear, for example sprocket, a common four stroke engine can be converted into an engine of the invention. Just the rocker arms for driving the outlet valves are taken off. Then the common outlet valve remains closed at all times. The cylinder block of the common engine becomes replaced by one of the invention, and the common four stroke eingine has obtained the increased power by these means of the invention. Naturally the charger, for example, 69 has to be added. Thus, by the means of the invention, the take off power of common aircraft engines can be multiplied by the small modifications, as described above. The above at hand of the sample of FIGS. 7 to 9 described timely distanced supply of air and later of fuel-air mixture into cylinder 11 is done in order to prevent any escape of fuel-air mixture through the outlet slots 1 of the invention. This provision overcomes the trouble of common two stroke engines, where fuel-air mixture can timewise escape from the outlet slots. Thus, the invention prevents the efficiency losses of common two-stroke engines. Instead of sending the different gases timely distanced into the cylinder, it would also be possible to send the air to one of both inlet valves 3 into cylinder 11 of figure one and the air mixture thereafter through the other inlet valve 3 of FIG. 3. In such case separated inlet ports have to be provided in the valve head. For example one on the right side, as 84 in FIG. 1 and another on the left side.

To provide two different flows of gases, for example, one flow of pure air and another flow of air-fuel mixture, the turbocharger of FIG. 12 of the invention differs from the common turbocharger insofar as shaft 72 is elongated, a second compressor rotor 67 is mounted on the elongated shaft and a respective additional housing portion with exit port 68 is provided. The described means prevent escape of air-fuel mixture through the exhaust ports 1 of the invention and thereby prevent losses of fuel and increase or provide a good efficiency and fuel economy of the invention.

A further difficulty of common four stroke engines is, that the exhaust pipes go in forward direction of the engine. That prevents a good cooling air flow to the engine's cylinders and valve head and also it heats the cooling air up before the cooling air reaches the ribs, which it should cool. The exhaust collection chamber 2 of the invention exhousts all hot exhaust gases to the end of the engine directly into entrance port 70 of the turbocharger of FIG. 12 or of any common turbocharger. This spares the heretofore used long pipes from the front of the engine to the turbocharger in the back of the engine of motorcycles and other vehicles. But in addition, since the forward hot exhaust pipes are prevented by this this invention, there is now nothing left, which could disturb the flow of good cooling air to the cooling ribs of the engine. Thus, the cooling of the engine is effectively increased by the provision of the means of this invention.

A further feature of the engine of the invention is, that at times of required high power, the engine can run with 3,5 times of the power of the common four stroke engine at same weight of the engine or at even little less weight.

But, that is not all. Because the engine of the invention may over longer time operate with more fuel economy than the common four stroke engine. For example, a vertical take off aircraft requires a very high power at vertical flight, like take off and landing. But at forward flight it uses only a fraction of the take off power. At such foreward flight the aircraft will fly much longer than at the short time of vertical take off or landing. The long forward flight, thus, desires fuel economy at our times of shortness of fuel. This can be obtained by the means of the invention. For example by running the engine with a high over air ratio "lambda". Common engines run with "lomba"=about 1, which means with so much fuel, that it just burnes in the air. The fuel is just the stochimetric value needed to burn the respective amount of fuel in the respective amount of air. But in fuel economic operation, a high over air ratio, for example two or mor times, than lambda=1 the thermal efficiency of the engine increases. That results in less power, but in less fuel consumpption per used HP too. Such fuel economy is highly desired. In the common four stroke engine it was difficult to achieve this desired fuel econly, because the benefit in thermal efficiency would be eaten away again by the bigger ftiction losses at only one working stroke at two crankshaft revolutions. But, the engine of the invention has only two strokes per one power stroke. Thus, it has only half of the friction in valves, piston on cylinder wall, crankshaft bearings and like. The sum of friction per power stroke reduced, the engine leaves the possibility of using a higher air ratio lambda. Because much less friction of the engine per power stroke takes much less friction losses away from the power stroke, than a conventional four stroke engine does. Thus, the engine obtains at higher air ratio "lambda" a better total efficiency than the common four stroke engine.

Figure 10:
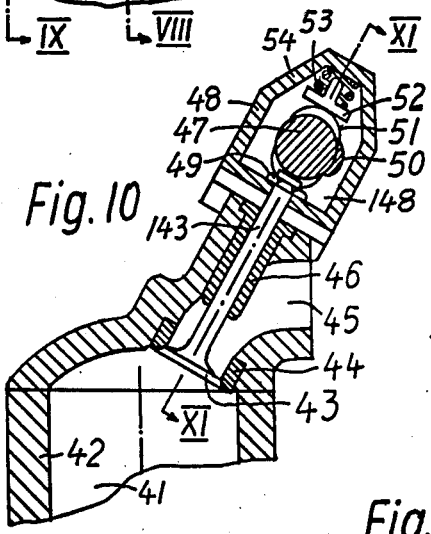
FIG. 10 is a longitudinal sectional view through another embodiment of the invention.
Figure 11:
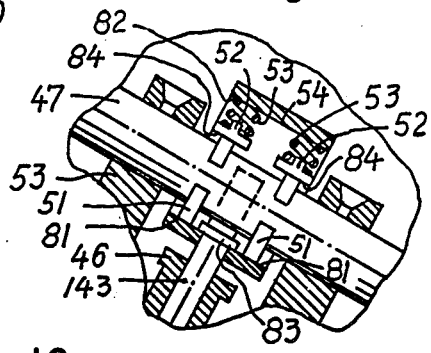
FIG. 11 is a cross-sectional view through FIG. 10 along XI—XI.

In FIGS. 10 and 11 an improved valve is shown, which can be used in the engine of this invention, but also in any common four stroke combustion engine.

The commonly used valves in common four stroke engines have the difficulty, that the valve is lifted against a strong spring set. The strong spring set closes the valves, at those times, when the valve is required to be closed and when not any action to open the valve by force is acting. The valve opener, for example cam shaft or cam shaft and rocker or bar, open the valve against the spring set in the full stroke of the respective valve. Thus, the common spring set of the valve in the common engine experiences a compression in the full extent of the valve stroke. This is a considerable compression length for a spring. It reduces the life time of the spring set and requires strong and long springs of best material and manufacturing. Said difficulty can be overcome by the means of FIGS. 10 and 11 of the invention.

The valve 43 is, as common in present day four stroke engines, borne on seat 44, when closed. It seals against the seal seat insert 44. From the back of the valve disc 43 extends in the known style the valve shaft 143 and said shaft 143 is guided in the guide bush 46 for the exail movement of the valve 43-143. The valve shaft 143 extends through the inlet port 45 in the known way. For opening of the valve a rocker or cam shaft pushes the valve 43-143 in the direction towards the cylinder, whereby the valve disc 43 opens away from the valve insert seat 44. Insofar the valve is common in four stroke engines and well known.

According to the invention however, the valve shaft 143 is much shorter, than in the common engine. That is, because according to this embodiment of the invention, the common spring is eliminated, since it was a most loaded and most endangered part of the common engine. Instead of the heretofore common spring, only the holder bottom of holder 48 is fastend to the valve stem or valve shaft by holding retainer 49. The holder 48 is hollow in order to make the insertion of a valve rocker or the insertion of a cam shaft through it possible. In the FIGS. 10 and 11 the camshaft 47 is extended through the axially open recess, 48 of hollow holder 48. The camshaft 47 has the generally known knock body portion, curved portion or medial cam 50 with an outer face 83 which, when the camshaft 47 is turned, thrusts against the valve end and forces it downward for opening from valve seat body 44. Such opening procedure for opening the valve is generally used. However, the commonly used valve stem or valve shaft 143 is much longer than in the valve of the invention because it includes a complete spring set between bush 46 and holder retainer 49. But in the invention, the distance from the valve guide bush 46 to the holding retainer means 49 is only very short. In fact, only slightly longer, than the valve opening stroke is. According to the invention, the holder 48 which is also called the valve head 48, includes a top portion 54 opposite to the bottom portion of it. On top of the camshaft 47 or on top of a respective rocker arm is a small spring set 53 provided with a pair of guide slide bodies on portion 52. Instead of one, there is a pair provided or a plurality of these members as demonstrated in FIG. 11. The small spring set 53 of the invention is borne on one end the the slide body on 52 and on the other end by the upper portion 54 of the holder 48. It is preferred to set the camshaft 47 sidewards of the valve stem 143 into bearings 55 wherein the cam shaft or rotary member 47 can revolve. In the embodiment of FIGS. 10 and 11 there are two sets of small springs 53 and also two sets of slide bodies 52. Each one to each spring 53. The slide members 52 are pressed with their traction faces 84 against the outer surface or control face 81 of the respective outer cam of the camshaft by springs 53. The cam shaft of this embodiment of the FIGS. 10 and 11 has laterally distanced a little from the main knock body portion medial cam or thrust portion 50 are rather oppositionally located upwards thrust body configurations or outer cams 51 provided on the cam shaft 47. They extend over a much wider angle around the camshaft 47 than the downward thrustportion 50 does. The said upward thrust configuration body portions or outer cams 51 are lifting the valve 43–143 upwards to close it on valve seat 44 by pressing against the upper portion 54 of holder 48. Opposite diametrically to the downward thrustportion 50 are no upward thrust portions 51. Thus, the upward and downward thrust portions 50 and 51 co-operate together inside the hollow holding member 48 to move the valve 43,143 upwards to close and downward to open the relation to the rotation of the cam shaft and of the crankshaft or move of the piston of the engine. If the inner configuration of holder 48 is exactly machined to match the radii or radially extending curved portions of thrust portions 50 and 51 of the camshaft, there would not be any need for spring sets 53. The camshaft would just rotate around in the hollow holder 48 and thereby move the valve 43 up and down for open and close, as desired in the engine. In order however, to allow a small machining mistake in the inner configuration of the holder 48, the valve set including the slide portion, namely 53 and 52 can be incorporated into the interior of the holder 48. It is thus left up to the designers choice, either to use spring sets 53 and slide bodies 52 inside the hollow holder 48 or likewise to broach the inner configuration of the holder 48 exactly and let the thrust configurations 50 and 51 slide along the respective inner face portions 82 of the bottom and of the top of holder member 48.

When the spring set (s) 53,52 is (are) provided, a good closing of the valve disc 43 on the valve seat 44 is assured by the force of said spring set 53,52. The spring set 53 does almost not any expansion or contraction work in this invention. It is almost stationary in rest respective to its own compression and expansion. It only maintains a force against the valve 43-143. It keeps it close on the seat 44. It moves together with the entire valve up and down during valve-operation. The spring deflection is therefore so very small, that the life time of the spring is increased many times compared to the valve springs of common four stroke engines and also the spring is much shorter and of much less weight, than the springs of the common engines are.

Thus, the reduction of spring deflection, the reduction of weight and the more reliable structure provides a valve means of higher reliability and of higher life, than the common valves of four stroke engines of today. Therefore, the valve assembly of the embodiment of FIGS. 10 and 11 of the invention does not only increase the life time and reliability of the valve of the invention, but can equally increase the life, speed and reliability of valves in common four stroke engines, if applied in them as inlet or outlet valve means.

Since the valve of said figures is shorter and the entire valve-spring set weight is less than in the common four stroke engine, the valve set of the invention can operate with higher cycles, which means with higher rpm and can thereby increase the power of engines whereto it will be applied and at same time slightly even reduce the weight of such engines.

The figures demonstrate only samples and embodiments of the invention. Any suitable modification falls within the scope of the invention, provided that it serves equal purposes as described in this invention. The invention may not only be applied to crankshaft operated piston engines but also to free piston engines or to hydraulically operated piston engines, for example as in my U.S. Pat. Nos. 2,260,213 or 3,269,321.

SUMMARILY, the invention provides:

(a) A reciprocating combustion engine including substantially a structure of a cylinder 12, a piston 19 reciprocating in said cylinder, a top 9 for closing one end of said cylinder, inlet means 15,17 and outlet means 7,15,17, extending to and from said cylinder for the intake of gas and the expellation of exhaust gases, air in said gas, provisions to add fuel to said air to provide a combustible gas, ignition provisions to ignite said combustible gas, cooling faces 14 applied to said cylinder and to said top, wherein said means includes at least one reciprocable valve 43,143, wherein said valve has a stem 143, a seat portion 43 and a head 48, wherein said seat portion periodically opens and closes a valve seat 44 on said means, wherein said top includes a rotary member 47 borne in said top, wherein said rotary member includes radially extending curved portions 50,51, wherein said valve head includes a recess (window) 148 through said head in a direction normal to the direction of the axis of said stem, wherein said rotary member extends through said recess, wherein said recess has inner faces 91,92, wherein said inner faces include at least one thrust face and at least one traction face 91 and 92; and wherein said curved portions are sliding along said faces to periodically retract and thrust said valve into open and closed positions relatively to said valve seat.

(b) The engine of a, wherein spring means 53 are interposed between said traction face and said curved portions.

(c) The engine of b, wherein slide bodies 52 are interposed between said spring means and said curved portions.

(d) A valve arrangement substantially of a, b or c, provided not to an engine, but to a compressor, motor, transmission or pump.

What is claimed is:

1. A reciprocating combustion engine including substantially a structure of a cylinder, a piston reciprocating in said cylinder, a top for closing one end of said cylinder, inlet means and outlet means extending to and from said cylinder for the intake of gas and the expellation of exhaust gases, air in said gas, provisions to add fuel to said air to provide a combustible gas, ignition provisions to ignite said combustible gas, cooling faces applied to said cylinder and to said top, wherein said means include at least one reciprocable valve which has a stem, a seat portion and a head, wherein said seat portion periodically opens and closes a valve seat on said means, wherein said top includes a rotary member borne in said top with said rotary member forming radially extending curved portions while said valve head includes a recess which extends through said head in a direction normal to the direction of the axis of said stem and said rotary member extends through said recess, wherein said recess has inner faces on said head which include at least one thrust face and a pair of traction faces, wherein said radially curved portions include for each individual valve of said at least one valve three curved portions which constitute three cams, whereof one is a medial cam while the two other cams are axially of said medial cam provided outer cams, wherein said medial cam has an outer face which is provided above said thrust face and said outer cams are provided with control faces which are located below said traction faces respectively, and, wherein said outer face slides periodically along said thrust face while said control faces slide periodically over said traction faces to periodically retract and thrust at different times of a revolution of said rotary member said valve into open and closed position relatively to said valve seat.

2. The engine of claim 1, wherein spring means are interposed between said traction faces and slide bodies which are interposed between said spring means and said outer cams to form on said slide faces said control faces.

3. A valve arrangement provided to a portion of a body of an engine, compressor, motor, transmission or pump, wherein said body includes inlet means and outlet means, wherein said means include at least one reciprocable valve which has a stem, a seat portion and a head, wherein said seat portion periodically opens and closes a valve seat on said means, wherein said top includes a rotary member borne in said top with said rotary member forming radially extending curved portions while said valve head includes a recess which extends through said head in a direction normal to the direction of the axis of said stem and said rotary member extends through said recess, wherein said recess has inner faces on said head which include at least one thrust face and a pair of traction faces, wherein said radially curved portions include for each individual valve of said at least one valve three curved portions which constitute three cams, whereof one is a medial cam while the two other cams are axially of said medial cam provided outer cams, wherein said medial cam has an outer face which is provided above said thrust face and said outer cams are provided with control faces which are located below said traction faces respectively, and, wherein said outer face slides periodically along said thrust face while said control faces slide periodically over said traction faces to periodically retract and thrust at different times of a revolution of said rotary member said valve into open and closed position relatively to said valve seat.

4. The arrangement of claim 2, wherein spring means are interposed between said traction faces and slide bodies which are interposed between said spring means and said outer cams to form on said slide faces said control faces.

* * * * *